US006192211B1

(12) United States Patent
Kimura

(10) Patent No.: US 6,192,211 B1
(45) Date of Patent: Feb. 20, 2001

(54) REVOLVER DEVELOPING APPARATUS METHOD, AND IMAGE FORMING APPARATUS AVOIDING STRESS AGAINST DEVELOPER

(75) Inventor: Noriyuki Kimura, Kawasaki (JP)

(73) Assignee: Ricoh Co., Ltd., Tokyo (JP)

( * ) Notice: Under 35 U.S.C. 154(b), the term of this patent shall be extended for 0 days.

(21) Appl. No.: 09/494,662

(22) Filed: Jan. 31, 2000

(30) Foreign Application Priority Data

Jan. 29, 1999 (JP) ..... 11-02148
Dec. 28, 1999 (JP) ..... 11-373496

(51) Int. Cl.[7] ..... G03G 15/01; G03G 15/08
(52) U.S. Cl. ..... 399/227; 399/119; 399/258; 430/120
(58) Field of Search ..... 399/227, 226, 399/224, 223, 258, 119, 120, 262; 430/120

(56) References Cited

U.S. PATENT DOCUMENTS

| | | | | |
|---|---|---|---|---|
| 4,622,916 | * | 11/1986 | Tanaka et al. | 399/227 X |
| 4,743,938 | * | 5/1988 | Ohno | 399/227 |
| 4,821,075 | * | 4/1989 | Saito et al. | 399/227 X |
| 5,331,390 | | 7/1994 | Kimura et al. | 399/227 |
| 5,465,139 | | 11/1995 | Kimura et al. | 399/260 |
| 5,537,197 | | 7/1996 | Fujishiro et al. | 399/228 |
| 5,565,973 | | 10/1996 | Fujishiro et al. | 399/227 |
| 5,583,630 | | 12/1996 | Kimura et al. | 399/227 |
| 5,655,193 | | 8/1997 | Fujishiro et al. | 399/256 |
| 5,671,465 | | 9/1997 | Kimura et al. | 399/119 |

FOREIGN PATENT DOCUMENTS

| | | | |
|---|---|---|---|
| 58-172660 | | 10/1983 | (JP) . |
| 05313488 | | 11/1993 | (JP) . |
| 8-006399 | * | 1/1996 | (JP) . |
| 08328367 | | 12/1996 | (JP) . |
| 099218575 | | 8/1997 | (JP) . |
| 10319665 | | 12/1998 | (JP) . |
| 11-038741 | * | 2/1999 | (JP) . |

* cited by examiner

*Primary Examiner*—Sophia S. Chen
(74) *Attorney, Agent, or Firm*—Oblon, Spivak, McClelland, Maier & Neustadt, P.C.

(57) ABSTRACT

A revolver developing apparatus including a developing device configured to rotate, including, a developing unit configured to apply a developer to the image bearing member in order to develop the latent image, and a developer storing unit provided at an end of the developing unit, and configured to supply the developer to the developing unit, wherein the developing device rotates such that the developer in the developer storing unit is conveyed longitudinally into the developing unit.

12 Claims, 10 Drawing Sheets

REVOLVER DEVELOPING APPARATUS METHOD, AND IMAGE FORMING APPARATUS AVOIDING STRESS AGAINST DEVELOPER

CROSS-REFERENCE TO RELATED APPLICATIONS

This application claims benefit of priority under 35 U.S.C. §119(a) from Japanese Patent Application No. 11-021482 filed Jan. 29, 1999, the entire contents of which are incorporated by reference herein, and from Japanese Patent Application No. 11-373496 filed Dec. 28, 1999, the entire contents of which are incorporated by reference herein.

BACKGROUND OF THE INVENTION

1. Field of the Invention

The present invention relates to a revolver developing apparatus for use in a multi-color image forming apparatus such as a copying machine, a facsimile, a printer, or the like.

2. Description of the Related Art

An image forming apparatus such as a full color copier is known to form color toner images on a transfer sheet by the following process steps: electrostatically forming a latent image of a color separated image on an image bearing member; developing each latent image with a toner of respective complementary colors; and transferring each color toner image to a single transfer sheet with each color toner image superimposed with each other. A multi-color image forming apparatus is also known which forms a latent image to be developed in each different color one by one on an image bearing member, develops the latent image with each developer of different color, and transfers each color toner image to a single transfer sheet with each color toner image superimposed on each other.

In the above-described image forming apparatuses, a developing apparatus with a plurality of developing devices is necessary to form multi-color toner images. Consequently, if respective developing devices are independently arranged around the image bearing member, then the size of the developing apparatus increases.

Accordingly, a revolver type developing apparatus has been developed. Specifically, this type of developing apparatus has a rotating member which supports a plurality of developing devices at predetermined positions thereof. The rotating member is rotated to locate sequentially the developing device at a developing position. Latent images formed on the image bearing member are developed by each developing device with a toner of a particular color.

In the above-described revolver type developing apparatus, it is necessary to provide a toner storing section of the developing apparatus which stores sufficient amounts of toner required for a predetermined number of image forming operations. A sufficient amount of toner must be supplied from the toner storing section to a developing roller to develop latent images on the image bearing member.

For example, Japanese Laid-open Patent Publication No. 58-172660 describes a developing device in which a plurality of toner storing sections are provided and toner is deposited in each of toner storing sections divided by radial partition members.

In the developing device described in Japanese Laid-open Patent Publication No. 58-172660, toner can not be replenished from outside of the developing device into the toner storing section. Therefore, when toner is consumed in any one of the toner storing sections, it is necessary to replace a whole developing device with a new one even though toner is left in other toner storing sections. Alternatively, if the capacity of the toner storing section is increased in order to reduce the frequency of exchange of the developing device and to extend the useable period of the developing device, the developing device becomes large.

Another developing device is known wherein the developing device includes a casing disposed below and facing an image bearing member and is formed with an opening facing the image bearing member; a developing roller accommodated in the casing and partly exposed through the opening of the casing; a supply roller having a longitudinal access for supplying a toner to the developing roller, a toner storing section provided at one side of the developing device for storing the toner; and a conveyor member located upstream of a position where the toner is to be transferred from the supply roller to the developing roller with respect to an intended direction of movement of the supply roller for conveying the toner in a longitudinal direction of the supply roller, wherein toner is conveyed from the toner storing section into the casing and deposited within the casing such that substantially all of the developer is deposited above the longitudinal axis of the supply roller.

In the above-described developing device, toner around the conveyor member is subjected to stress (e.g., pressure) due to rotations of the conveyor member. In order to improve the fluidity of the toner and to gain appropriate chargeability of the toner, additives having smaller particles and higher hardness than toner, such as silica, titanium oxide or other similar additives, are mixed with the toner. Consequently, when the toner is subjected to stress over time, additive particles in the toner fall among the toner particles, the shape of pulverized toner particle change to round, and the average toner particle consequently becomes smaller. As a result, the chargeability of the toner is changed, and thus the image quality deteriorates. In addition, the fluidity of the toner is changed, and thus the uniformity of the image is reduced.

When the developing device is rotated for a multi-color image forming operation and the opening of the casing is directed downward, the toner deposited in the casing may leak from the opening and scatter around out of the casing.

SUMMARY OF THE INVENTION

Accordingly, one object of the invention is to provide a novel revolver developing apparatus and image forming apparatus, wherein reduction in image uniformity and a deterioration in image quality caused by stress to the toner are prevented.

Yet another object of the present invention is to provide a novel revolver developing apparatus and image forming apparatus that preferably convey a developer in a longitudinal direction of a developing unit.

Still yet another object of the present invention is to provide a novel revolver developing apparatus and image forming apparatus, wherein toner leakage and scattering are prevented.

These objects and others are achieved according to the present invention by providing a novel revolver developing apparatus including a developing device configured to rotate, including, a developing unit configured to apply a developer to the image bearing member in order to develop the latent image, and a developer storing unit provided at an end of the developing unit, and configured to supply the developer to the developing unit, wherein the developing device rotates such that the developer in the developer storing unit is conveyed longitudinally into the developing unit.

Other objects, features, and advantages of the present invention will become apparent from the following detailed description when read in conjunction with the accompanying drawings.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
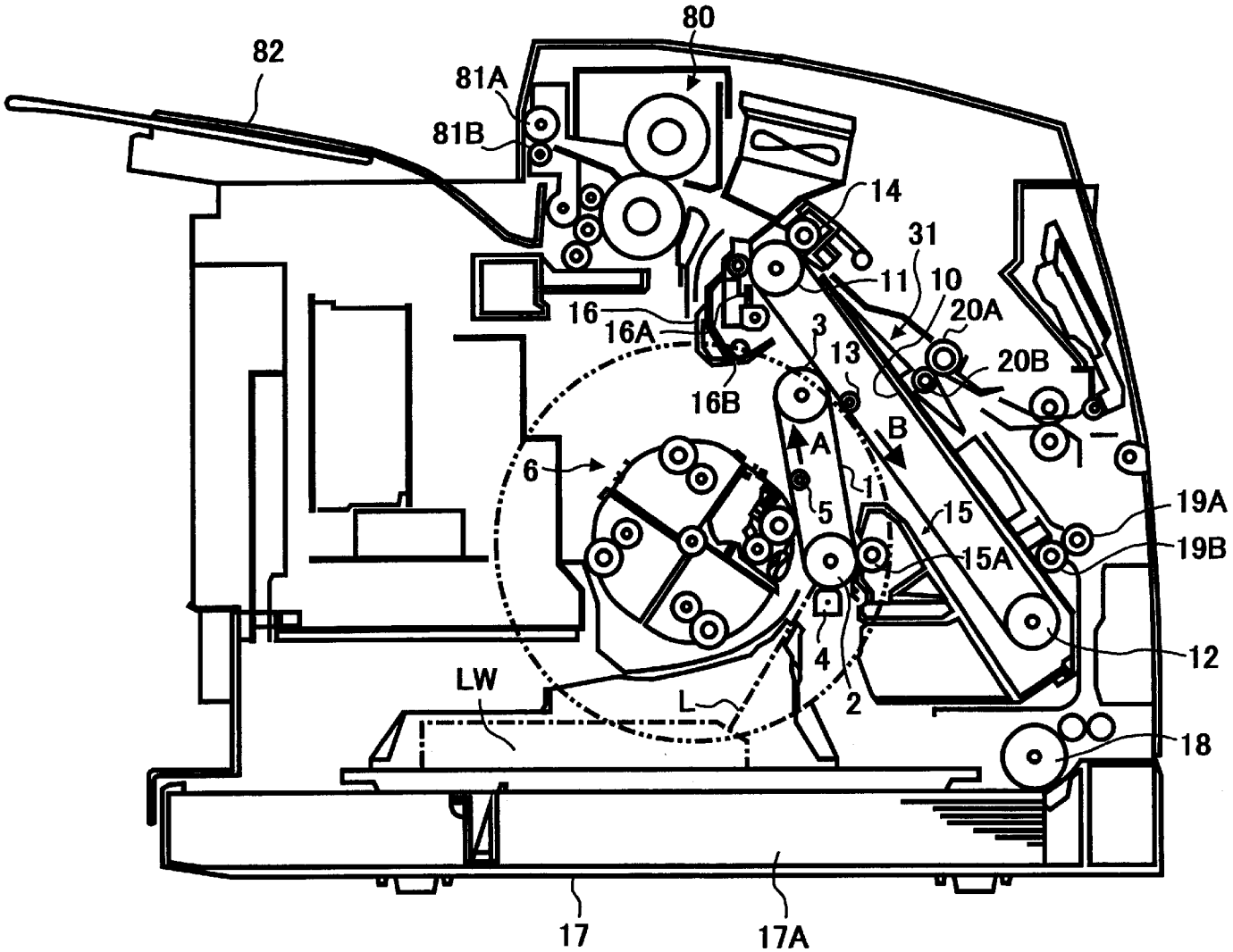
FIG. 1 is a schematic view illustrating an internal construction of a multi-color image forming apparatus according to an embodiment of the present invention.

Referring now to the drawings, wherein like reference numerals designate identical or corresponding parts throughout the several views, an embodiment of the present invention is now described. FIG. 1 is a schematic view illustrating an internal construction of a multi-color image forming apparatus according to an embodiment of the present invention. The multi-color image forming apparatus in FIG. 1 includes a revolver developing apparatus of the present invention.

Referring to FIG. 1, the multi-color image forming apparatus includes a flexible photoconductive belt 1 which functions as a belt-like image bearing member. The photoconductive belt 1 is spanned around a rotating roller 2 and a rotating roller 3, and is driven to rotate in the direction indicated by arrow A (i.e., in the clockwise direction) by the rotating roller 2.

Also illustrated in FIG. 1 is a charger 4 serving as a charging device that uniformly charges the surface of the photoconductive belt 1. A laser optical device LW serving as an exposing device exposes the surface of the photoconductive belt 1 to form static latent images thereon. Reference numeral 5 indicates a discharging roller and a reference numeral 6 indicates a revolver-type multi-color developing apparatus (hereinafter simply referred to as a revolver developing apparatus) that is integrally formed by four developing devices containing yellow, magenta, cyan, and black developers. Intermediate transfer belt 10 is spanned around a rotating roller 11 and a rotating roller 12, and is driven to rotate in the direction indicated by arrow B (i.e., in the counterclockwise direction) by the rotating roller 11. The photoconductive belt 1 and the intermediate transfer belt 10 contact each other at the rotating roller 3. A bias roller 13 having conductivity is provided at the contact side of the intermediate transfer belt 10 with the photoconductive belt in order to contact a backside surface of the intermediate transfer belt 10 under a predetermined condition.

When the multi-color image forming apparatus starts an image forming operation, the charger 4 uniformly charges the surface of the rotating photoconductive belt 1 first. Subsequently, the photoconductive belt 1 is exposed to image information by scanning with the laser optical device LW, and a latent image is formed on the surface of the photoconductive belt 1. The exposed image information is obtained by separating a desired full color image data into respective single color image data including yellow, cyan, magenta, and black. The surface of the photoconductive belt 1 is exposed by scanning with a laser beam L emitted from a semiconductor laser (not shown) based on the image information.

The revolver developing apparatus 6 develops the latent image with each predetermined color toner, such as, yellow, cyan, magenta, and black. As a result, each single color toner image is sequentially formed on the photoconductive belt 1. Each single color toner image formed on the photoconductive belt 1, rotating in the direction indicated by the arrow A, is sequentially transferred to the intermediate transfer belt 10 synchronously rotating in the direction indicated by the arrow B by a predetermined transfer bias applied by the bias roller 13 in an order of yellow, cyan, magenta, and black. As a result of the transfer, four color toner images are superimposed on each other on the intermediate transfer belt 10. The transfer order is not limited to the above-described order.

The yellow, cyan, magenta, and black toner images superimposed on the intermediate transfer belt 10 are transferred to a transfer sheet 17A at one time by a transfer roller 14. The transfer sheet 17A is fed from a sheet feeding cassette 17 by a sheet feeding roller 18 and conveyed to a transfer section via a pair of transfer rollers 19A/19B and a pair of registration rollers 20A/20B. After being transferred to the transfer sheet 17A, the color toner image is fixed on the transfer sheet 17A by a fixing device 80. The transfer sheet 17A with full color image is discharged to a sheet stacker unit 82 via a pair of discharging rollers 81A/81B.

Referring to FIG. 1, the multi-color image forming apparatus further includes a waste toner collecting device 15 having a cleaning member 15A that constantly contacts the photoconductive belt 1 and removes toner thereon. There is provided a cleaning device 16 including a cleaning blade 16A that cleans the intermediate transfer belt 10. The cleaning blade 16A is configured to be held in a non-contacting relation to the surface of the intermediate transfer belt 10 during an image forming operation, and to abut the surface of the intermediate transfer belt 10 after the color toner image on the intermediate transfer belt 10 is transferred to the transfer sheet 17A.

The waste toner removed from the intermediate transfer belt 10 by the cleaning blade 16A is transferred in a forward direction as seen in FIG. 1 by an auger 16B provided in the cleaning device 16. The waste toner is conveyed to the waste toner collecting device 15 by a transfer section (not shown) which is provided at the front side of a process cartridge 31. The process cartridge 31 is integrally provided with the photoconductive belt 1, the charger 4, the intermediate transfer belt 10, the cleaning device 16, and the registration roller 20B. The waste toner collecting device 15 is detachably installed to the process cartridge 31. When the waste toner collecting device 15 collects more than a predetermined amount of waste toner, the waste toner collecting device 15 is replaced independently of the process cartridge 31. Because it is not necessary to replace the whole process cartridge 31 when the waste toner collecting device 15 collects more than the predetermined amount of waster toner, the useful life of the process cartridge 31 is extended. The exterior part of the case of the process cartridge 31 at the side of the registration roller 20B also serves as a sheet transfer guide member.

Figure 2:
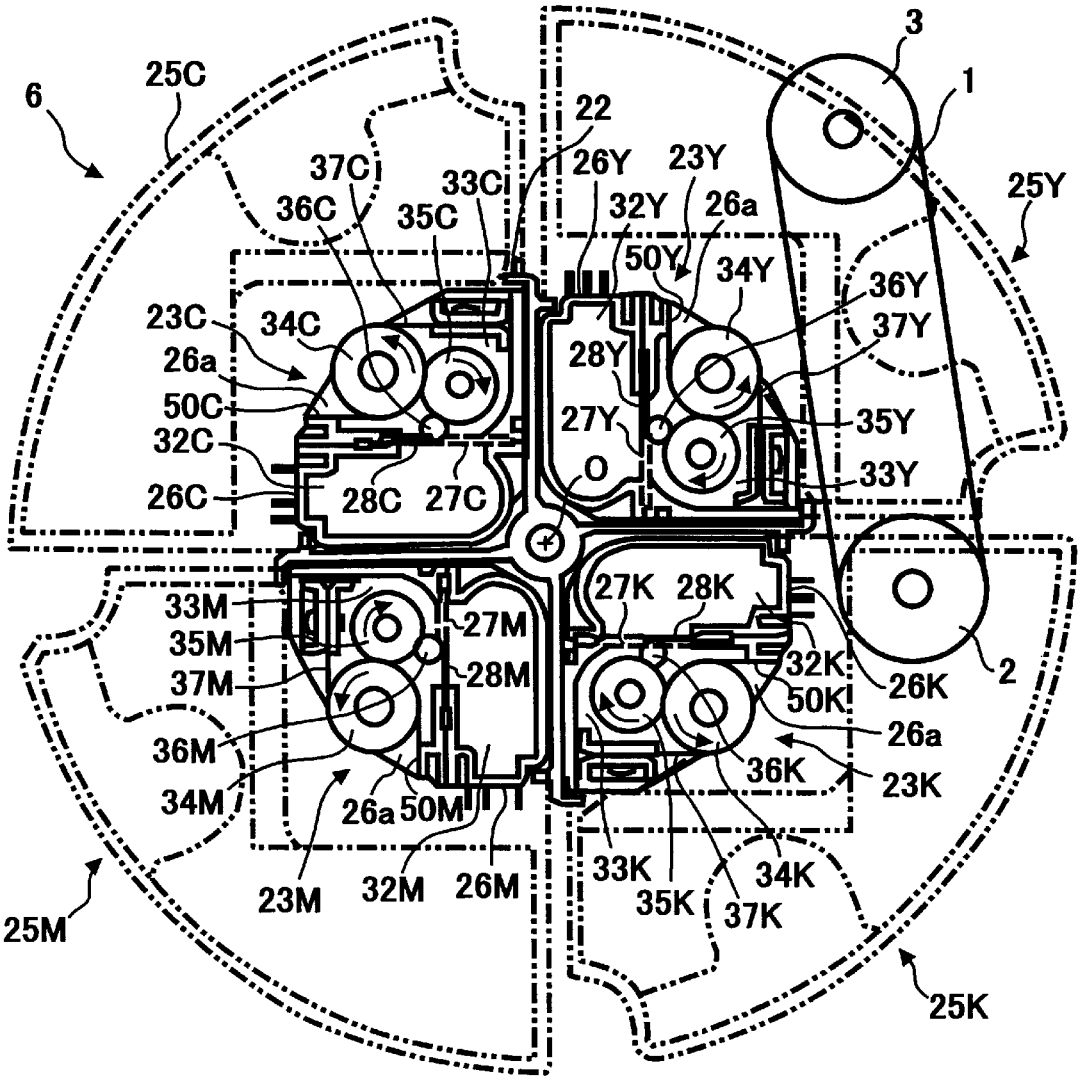
FIG. 2 is a vertical sectional view illustrating developing devices of a revolver developing apparatus included in the multi-color image forming apparatus of FIG. 1.
Figure 3:
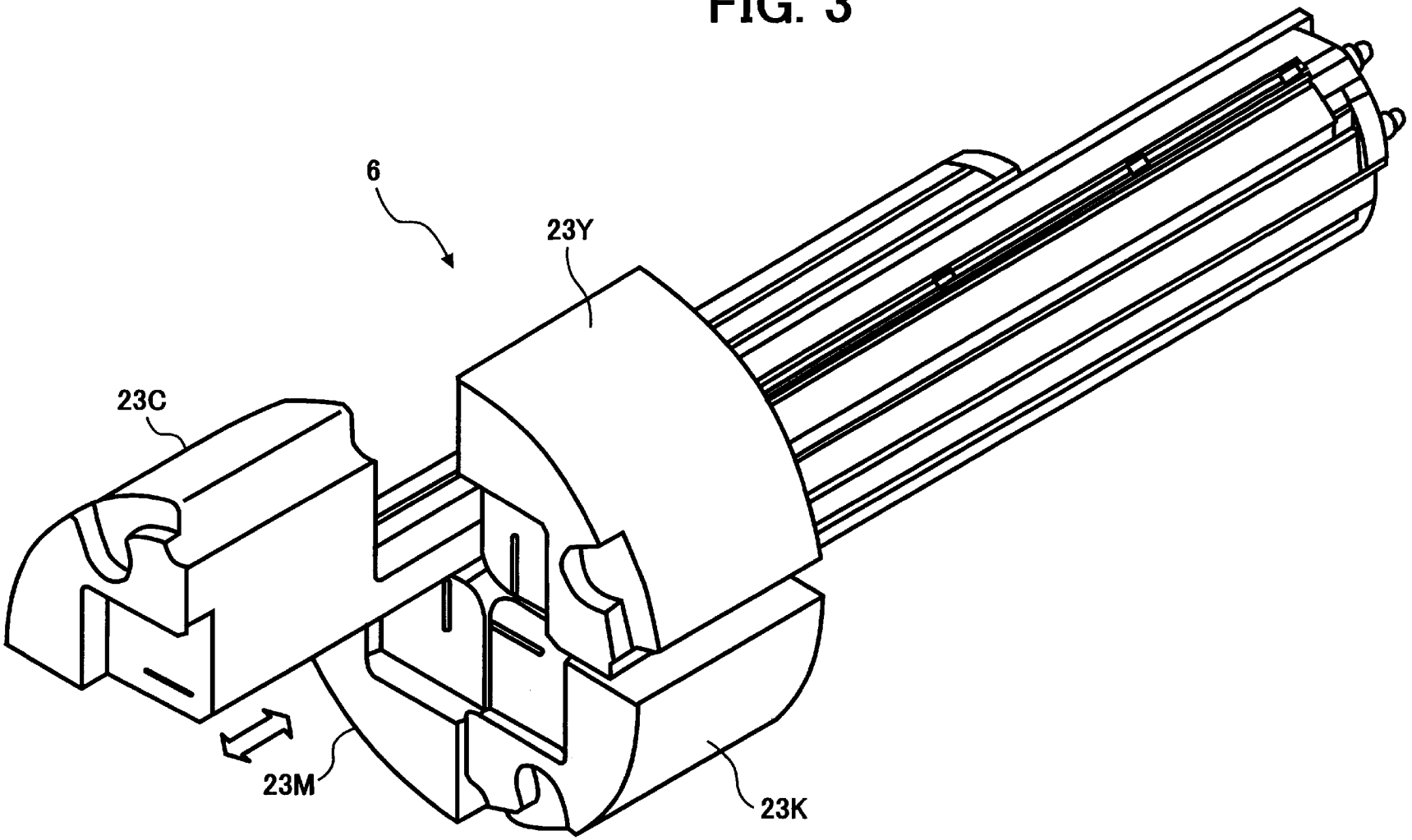
FIG. 3 is an external perspective view of the revolver developing apparatus of the present invention.

Referring to FIG. 2, the revolver developing apparatus 6 is supported by a rotating support member 22. A yellow, cyan, magenta, and black developing device, respectively 23Y, 23C, 23M, and 23K (hereinafter may be referred to as a developing device 23 as a whole), are provided in the revolver developing apparatus 6 such that each of the developing devices 23Y, 23C, 23M, and 23K is replaceable as illustrated in FIG. 3. Referring to FIG. 3, the illustrative cyan developing device 23C can be replaced as indicated by the double-headed arrow.

Figure 4:
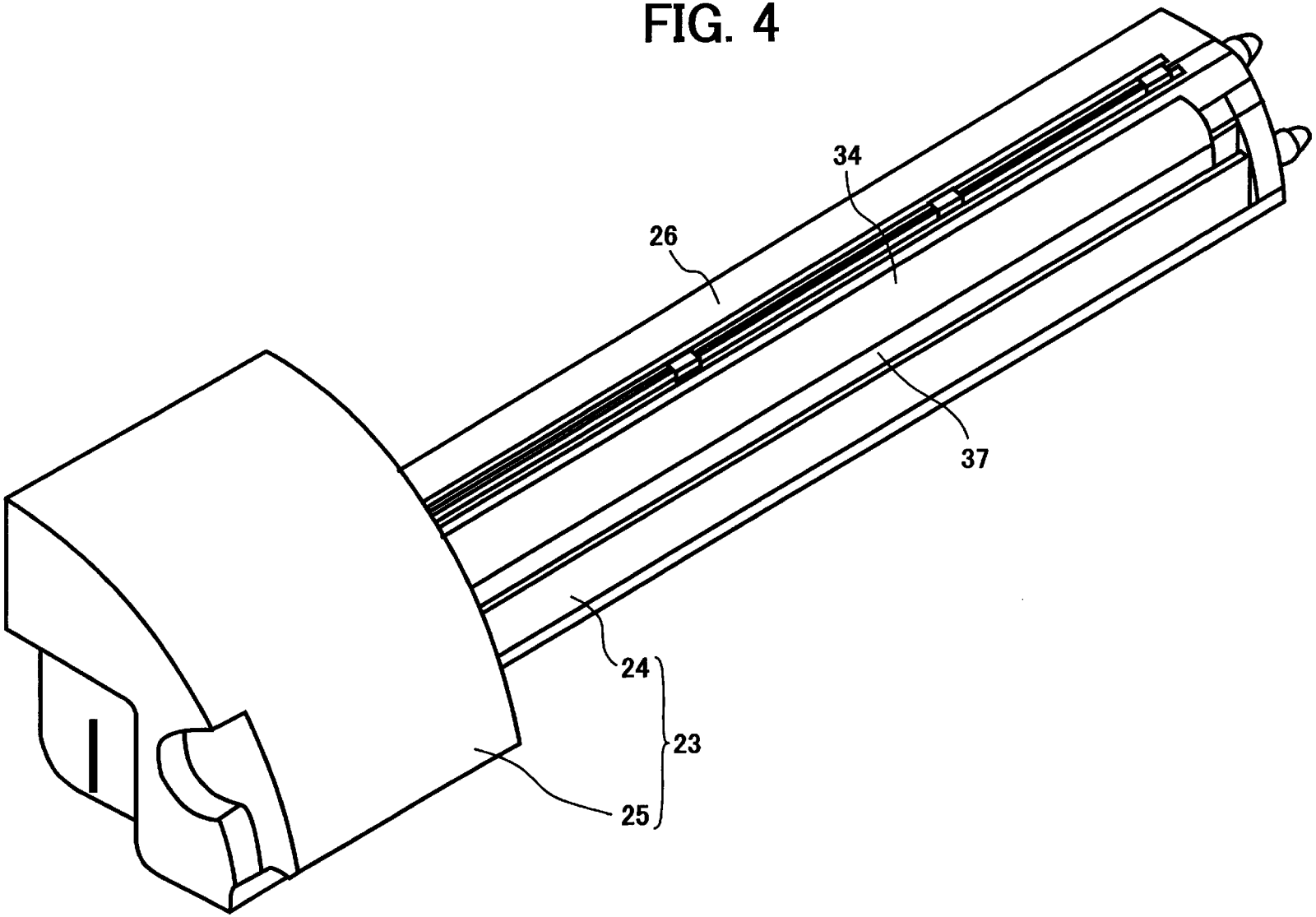
FIG. 4 is a perspective view of the developing device of the revolver developing apparatus of the present invention.

As illustrated in FIG. 4, the developing device 23 (-Y, C, M, K) includes respectively a quarter-cylindrical developing unit 24 (-Y, C, M, K) and a quarter-cylindrical developer storing unit 25 (-Y, C, M, K) which is integrally provided at an end of the developing unit 24.

As seen from FIG. 2, a separating member 28 (-Y, C, M, K) separates the inside of a case 26 (-Y, C, M, K) of the developing unit 24 (-Y, C, M, K) into a developer storing section 32 (-Y, C, M, K) that temporarily stores the developer supplied from the developer storing unit 25 (-Y, C, M, K) and into a developing section 33 (-Y, C, M, K) that applies the developer to the photoconductive belt 1. A communicating opening 27 (-Y, C, M, K) which communicates between the developer storing section 32 (-Y, C, M, K) and the developing section 33 (-Y, C, M, K) is provided at one side portion of the case 26 (-Y, C, M, K) such that the developer is conveyed from the developer storing section 32 (-Y, C, M, K) to the developing section 33 (-Y, C, M, K) through the communicating opening 27 (-Y, C, M, K).

Figure 7:
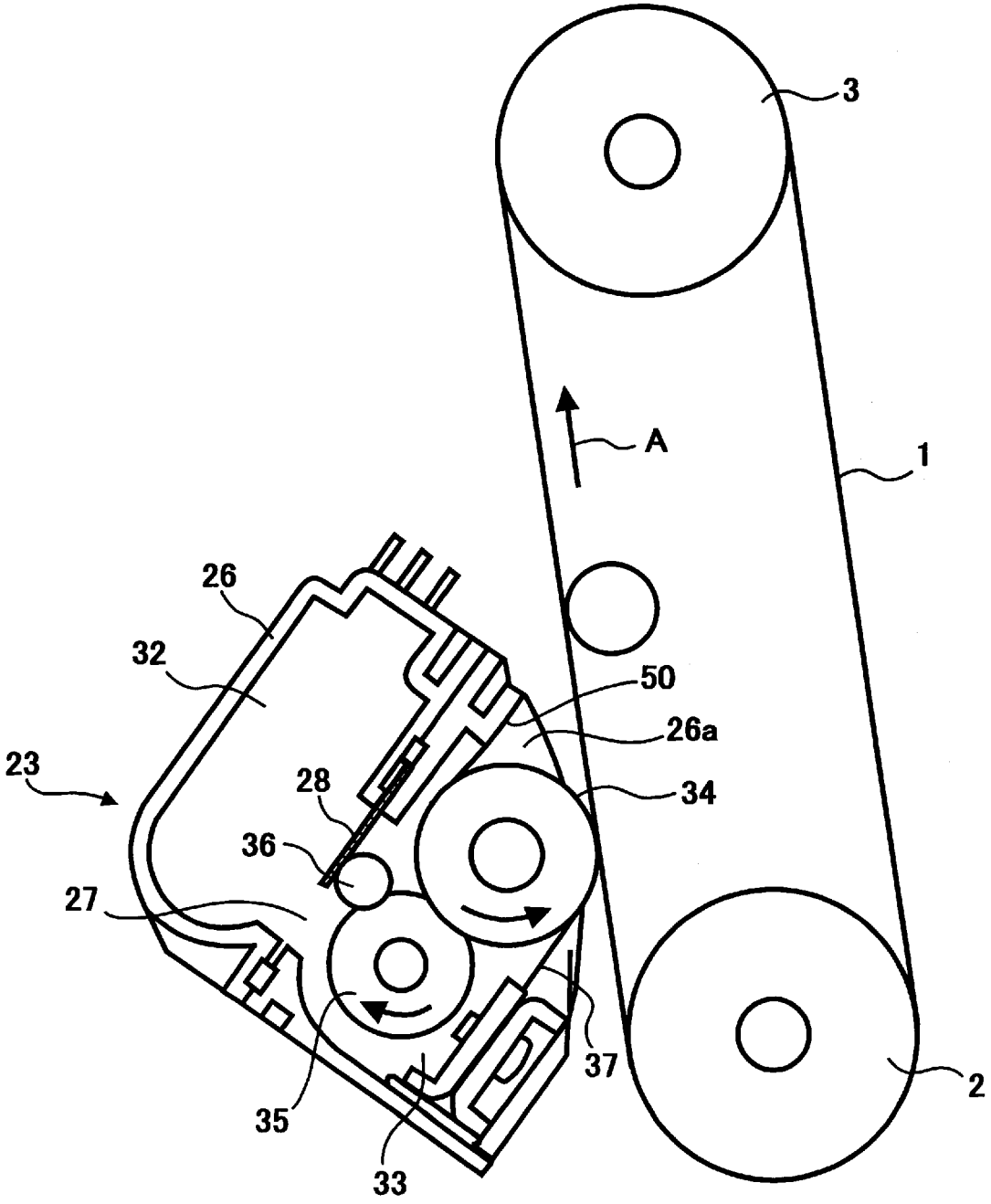
FIG. 7 is a partial diagrammatic view illustrating a condition when the developing device of the revolver developing apparatus moves to a developing position according to the embodiment of the present invention.

Referring to FIGS. 2 and 7, in the developing section 33 there are provided a developing roller 34 (-Y, C, M, K), a supply roller 35 (-Y, C, M, K), a flicker member 36 (Y,C, M, K), a blade 37 (-Y, C, M, K), and a seal member 50 (-Y, C, M, K). Each opening 26*a* is formed through the case 26 of the developing unit 24 such that a part of the developing roller 34 is exposed to the outside through the opening 26*a* to face the hotoconductive belt 1.

The supply roller 35 supplies developer to the developing roller 34 and is made of foam urethane or a similar elastic material. The flicker member 36 is a steel lumber round rod with about 5 mm diameter, and regulates the amount of developer on the supply roller 35 by intruding into the supply roller 35 by a predetermined amount. The flicker member 36 also serves to prevent the developer from being adhered on the surface of the supply roller 35. The blade 37 is made of a resilient thin plate such as a stainless steel plate, or an elastic member such as urethane rubber, and is located at a position upstream with respect to the rotating direction of the developing roller 34 and in the vicinity of the opening 26*a*. The blade 37 contacts the periphery of the developing roller 34 at one end thereof. The developer deposited on the developing roller 34 is leveled by the blade 37 to form a thin developer layer having a predetermined thickness. The blade 37 also serves to prevent the developer from leaking from the opening 26*a* and scattering out of the case 26. The seal member 50 is located at a position downstream with respect to the rotating direction of the developing roller 34 and is in the vicinity of the opening 26*a*, and contacts a part of the surface of the developing roller 34 at one end thereof The seal member 50 prevents the developer from leaking from the opening 26*a* and scattering out of the case 26.

Figure 5:
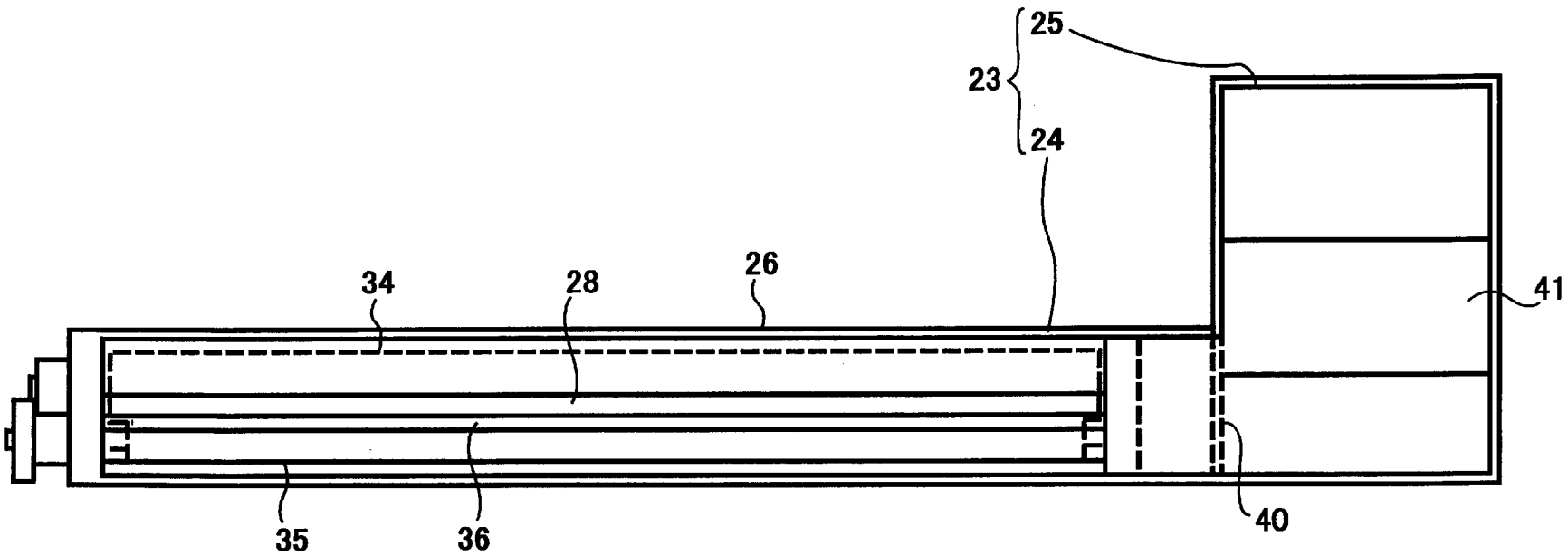
FIG. 5 is a schematic view illustrating an internal construction of the developing device of the present invention.

As illustrated in FIG. 5, the developing roller 34, the supply roller 35, and the flicker member 36 are provided in parallel with each other in a longitudinal direction of the developing unit 24 in the developing unit 24. The developer storing section 32 and the communicating opening 27 are also provided in the longitudinal direction of the developing unit 24 and extend in a direction parallel to a widthwise direction of the photoconductive belt 1. Because the developer storing section 32 and the communicating opening 27 extend in a direction parallel to the widthwise direction of the photoconductive belt 1, the developer is uniformly applied to the photoconductive belt 1.

Moreover, when the communicating opening 27 is directed in a vertical direction, the opening 26*a* of the case 26 is directed in a direction other than the vertical direction. Therefore, when the developer in the developer storing section 32 falls, due to gravity, to the developing section 33 through the communicating opening 27, the developer is prevented from leaking from the opening 26*a* and scattering out of the case 26. Furthermore, the above-described configuration reduces a burden on the blade 37 and the seal member 50 that serve to seal the opening 26*a*. Moreover, the separating member 28 separates the inside of the case 26 of the developing unit 24 into the developer storing section 32 and the developing section 33. Thus, an amount of developer conveyed from the developer storing section 32 to the developing section 33 through the communicating opening 27 is regulated. Thus, toner leakage and scattering are reduced.

Figure 6:
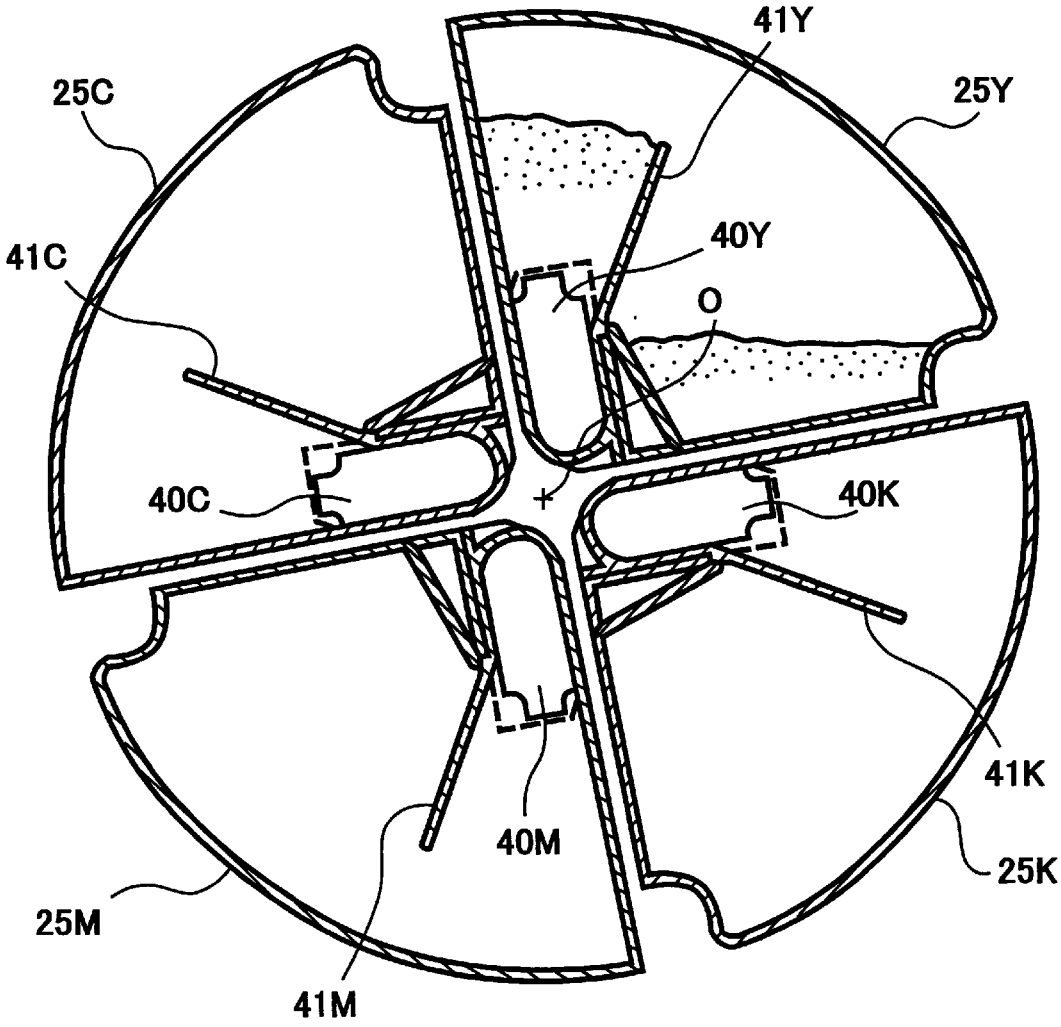
FIG. 6 is a vertical sectional view illustrating developer storing units of the revolver developing apparatus of the present invention.

As illustrated in FIG. 6, there are provided in the developer storing unit 25, an opening 40 (-Y, C, M, K) and a partition member 41 (-Y, C, M, K) at a side part upstream with respect to the rotating direction of the revolver developing apparatus 6 and in the vicinity of the rotation center O. The opening 40 connects to the developer storing section 32. The developer in the developer storing unit 25 accumulates between the partition member 41 and a side wall of the developer storing unit 25 and moves toward the opening 40 by rotation of the revolver developing apparatus 6.

As illustrated in FIG. 2, when the revolver developing apparatus 6 is located at a home position, a substantially intermediate part between the yellow developing device 23Y and the black developing device 23K faces the photoconductive belt 1, and none of the developing rollers 34Y, 34C, 34M, and 34K face the photoconductive belt 1.

When an image forming operation starts, the revolver developing apparatus 6 is rotated by a driving device (not shown) synchronously with receiving color image data around the rotation center O in the clockwise direction, as shown in FIG. 2. Then, the developing devices 23 (-Y, C, M, K) are selectively rotated to the developing position starting with the developing device 23Y such that the developing roller 34 faces the photoconductive belt 1 as illustrated in FIG. 7. The developer on the surface of the developing roller 34, which is supplied from the supply roller 35, is leveled by the blade 37 to form a thin developer layer having a predetermined thickness, and is then applied to the photoconductive belt 1 in order to develop a latent image formed on the photoconductive belt 1. When the developing device 23 is located at the developing position, the communicating opening 27 is located at the lowest position of the developer storing section 32 of the developing unit 24 such that the developer in the developer storing section 32 falls to the developing section 33 through the communicating opening 27 by gravity.

Figure 8A:
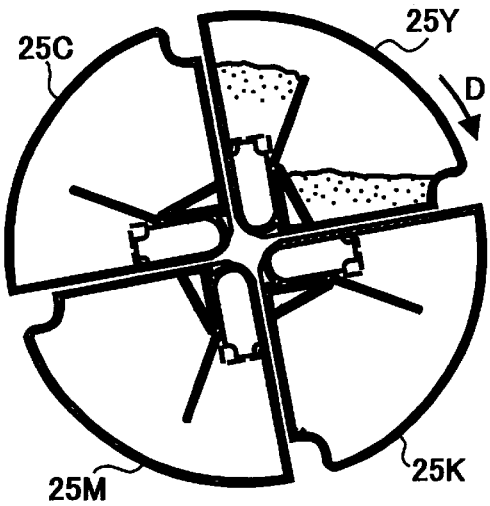
FIGS. 8A through 8E are explanatory views illustrating conditions when the developer storing units are rotated according to the embodiment of the present invention.
Figure 8B:
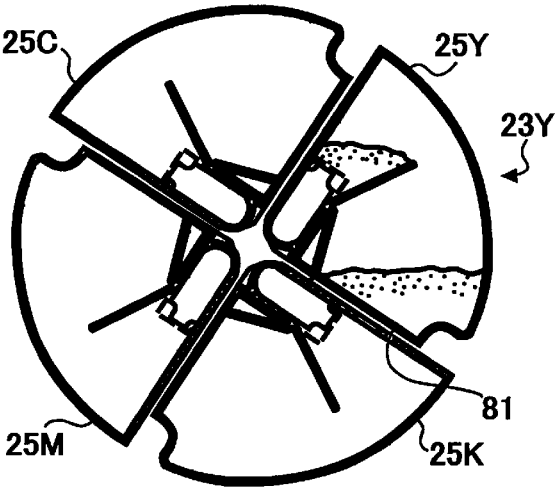

FIGS. 8A through 8E illustrate how the developer in the developer storing unit 25 accumulates between the partition member 41 and a side wall of the developer storing unit 25 and moves toward the opening 40. FIG. 8A illustrates the developer storing unit 25 when the revolver developing apparatus 6 is located at a home position. When the revolver developing apparatus 6 rotates in the direction indicated by arrow D and the yellow developing device 23Y moves to the developing position as illustrated in FIG. 8B, the developer in the yellow developer storing unit 25Y accumulates due to gravity at a corner 81 of the developer storing unit 25Y at the downstream side with respect to the rotating direction of the revolver developing apparatus 6.

Figure 8C:
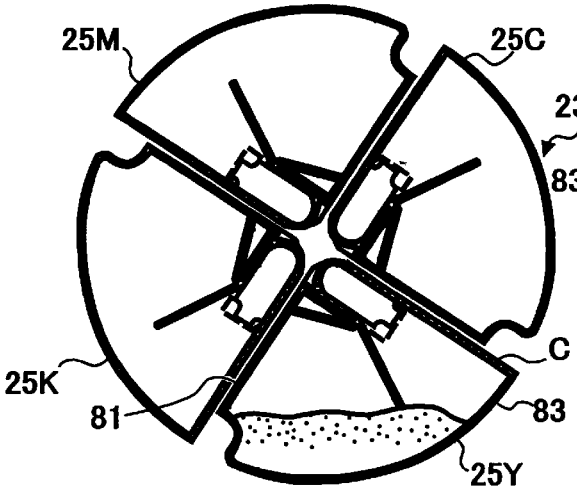
Figure 8D:
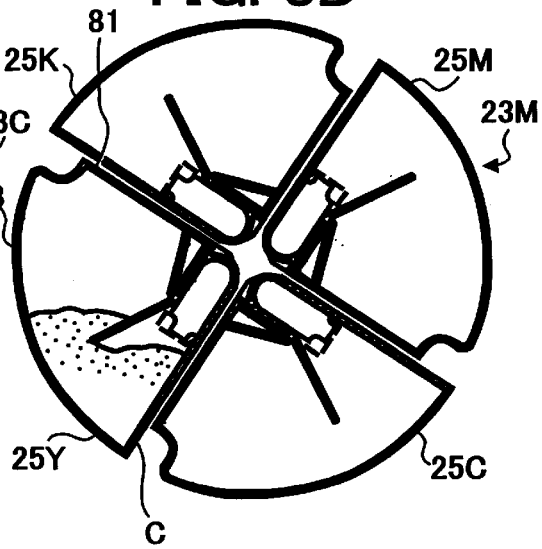
Figure 8E:
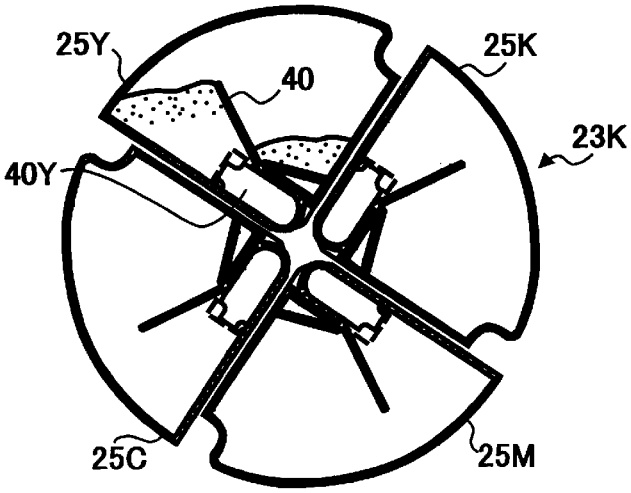

When the revolver developing apparatus 6 further rotates in the direction indicated by the arrow D and the cyan developing device 23C moves to the developing position as illustrated in FIG. 8C, the developer in the developer storing unit 25Y accumulates, due to gravity, on a circular part 83 of the developer storing unit 25Y. When the magenta developing device 23M moves to the developing position via the rotation of the revolver developing apparatus 6 as illustrated in FIG. 8D, the developer in the developer storing unit 25Y accumulates due to gravity at a corner C of the developer storing unit 25Y at the upstream side with respect to the rotating direction of the revolver developing apparatus 6. When the black developing device 23K moves to the developing position via the rotation of the revolver developing apparatus 6 as illustrated in FIG. 8E, the developer in the developer storing unit 25Y accumulates between the partition member 41Y and a side wall of the developer storing unit 25Y and moves toward the opening 40Y. When the revolver developing apparatus 6 is further rotated, the revolver developing apparatus 6 returns to the home position again as illustrated in FIG. 8A.

As seen from FIG. 6 and FIGS. 8A through 8E, when the amount and height of developer in the developer storing section 32 are reduced and when the developer in the developer storing unit 25 accumulates in a vertical direction relative to the opening 40 between the partition member 41 and the side wall of the developer storing unit 25, the developer in the developer storing unit 25 falls to the developer storing section 32 through the opening 40 due to gravity. In accordance with this configuration, if the developer storing section 32 is almost empty, one rotation or several rotations of the revolver developing device 6 enable the developer holding section 32 to replenish with developer.

Figure 9:
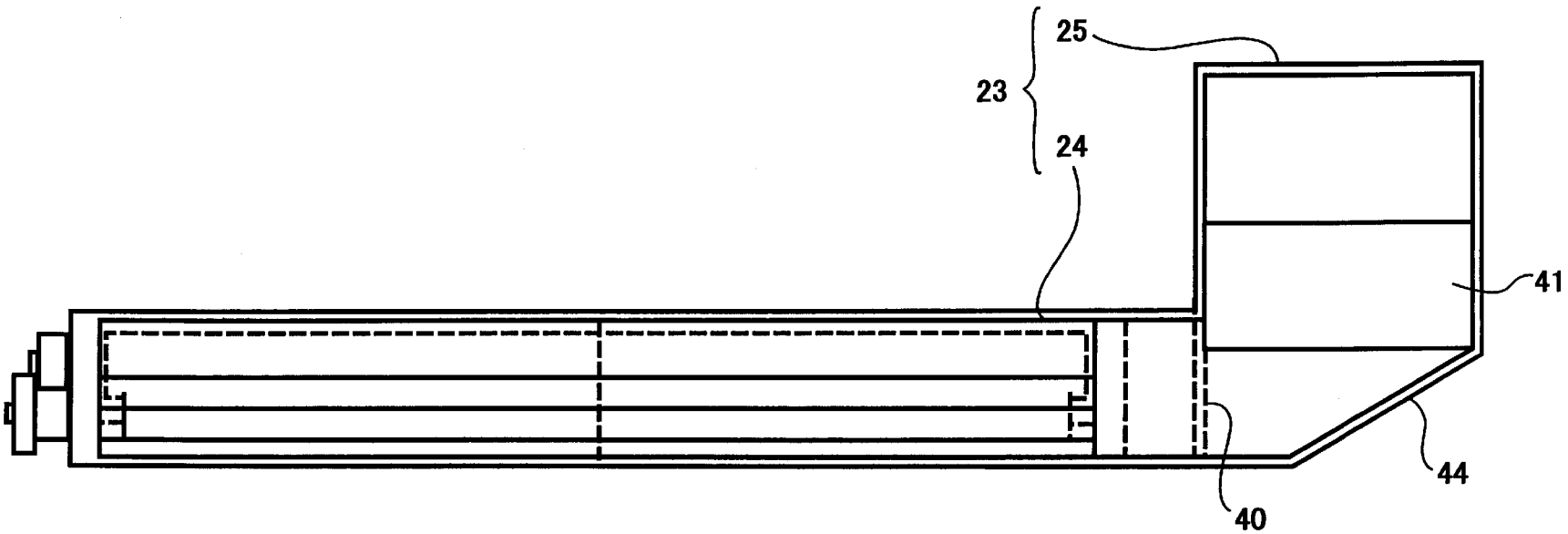
FIG. 9 is a schematic view illustrating an internal construction of an alternative developing device of the present invention.

Referring to FIG. 9, it is preferable that a case of the developer storing unit 25 should include a slant 44 so as to efficiently move the developer accumulated between the side wall of the developer storing unit 25 and the partition member 41 by rotation of the revolver developing apparatus 6 to the opening 40.

Figure 10:
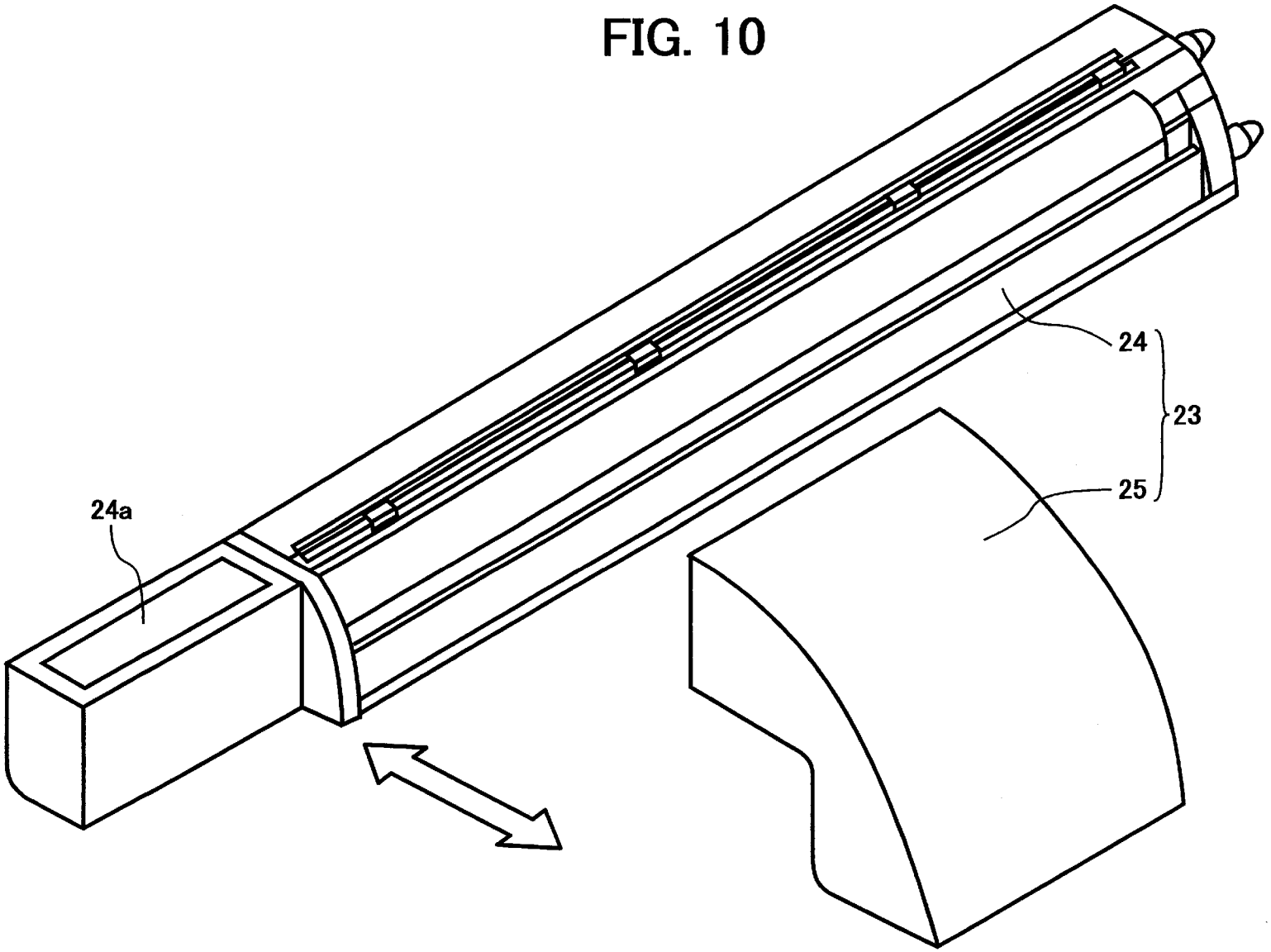
FIG. 10 is an exploded perspective view illustrating an alternative developing device of the present invention.

In accordance with this configuration, the developing unit 24 and the developer storing unit 25 are integrally provided in the developing device 23. Thus, when all the developer in the developer storing unit 25 is consumed, the whole developing device 23 needs to be replaced. Alternatively, as illustrated in FIG. 10, another developing device 23 may be employed in which the developer storing unit 25 and the developing unit 24 are separately provided. Accordingly, when all the developer in the developer storing unit 25 is consumed, only the developer storing unit 25 need be replaced. The developing device 23 in FIG. 10 includes a connecting opening 24a of the developing unit 24 that is connected to the developer storing unit 25.

As described above, the developer in the developer storing unit 25 is conveyed into the developing unit 24 in a longitudinal direction by rotating the revolver developing apparatus 6. Therefore, the developer should preferably have high fluidity. Specifically, when the developer having an angle of repose of not greater than 60 degrees is employed in the revolver developing apparatus 6, satisfactory results are obtained in conveying the developer rather than employing the developer having an angle of repose of greater than 60 degrees. In this embodiment, the angle of repose of the developer is obtained by dropping a test sample of developer to a horizontal plane and measuring an angle between the horizontal plane and inclined surfaces of the developer deposited on the horizontal plane.

Owing to the configuration of the revolver developing apparatus 6 wherein the developer is conveyed from the developer storing unit 25 to the developer storing section 32, and is then conveyed, due to the rotation of the revolver and gravity, from the developer storing section 32 to the developing section 33 in a longitudinal direction of the developing unit 24, and not to rotation of a conveyor member, the developer can be preferably applied to the photoconductive belt 1 without suffering stress caused by rotation of the conveyor member. As a result, a reduction in image uniformity and a deterioration in image quality caused by stress to the developer can be prevented. Moreover, because control devices which detect an amount of developer and control the amount of developer supply are not necessary, the multicolor image forming apparatus can be designed with numerous layouts, needs a minimum of sectional space relative to the photoconductive belt 1 and therefore can be reduced in size.

Obviously, numerous modifications and variations of the present invention are possible in light of the above teachings. It is therefore to be understood that within the scope of the appended claims, the present invention may be practiced otherwise than as specifically described herein.

What is claimed as new and is desired to be secured by Letters Patent of the United States is:

1. A revolver developing apparatus for developing a latent image formed on an image bearing member into a toner image, comprising:

a developing device configured to rotate, comprising, a developing unit configured to apply a developer to the image bearing member in order to develop the latent image, and a developer storing unit provided at an end of the developing unit, and configured to supply the developer to the developing unit, wherein said developing device rotates such that the developer in the developer storing unit is conveyed longitudinally into the developing unit and the developer has an angle of repose of not greater than 60 degrees.

2. The revolver developing apparatus according to claim 1, wherein:

the developer storing unit comprises a partition member; and the developing device is configured to rotate such that the developer in the developer storing unit accumulates between the partition member and a side wall of the developer storing unit.

3. The revolver developing apparatus according to claim 1, further comprising:

a separating member configured to separate a case of the developing unit into a developer storing section configured to store temporarily the developer supplied from the developer storing unit and into a developing section configured to apply the developer to the image bearing member; and a communicating opening situated between the developer storing section and the developing section provided at one side portion of the case such that the developer is conveyed from the developer storing section to the developing section through the communicating opening.

4. A revolver developing apparatus, comprising:

a plurality of developing devices configured to rotate collectively such that each developing device moves selectively to a developing position in order to develop a latent image on an image bearing member, each developing device comprising, a developing unit comprising an opening, and configured to apply developer to the image bearing member, a developer storing unit configured to supply the developer to the developing unit, a separating member configured to separate a case of the developing unit into a developer storing section configured to store temporarily the developer supplied from the developer storing unit and into a developing section configured to apply the developer to the image bearing member, and a communicating opening situated between the developer storing section and the developing section provided at one side portion of the case such that the developer is conveyed from the developer storing section to the developing section through the communicating opening;

wherein the opening of the developing unit is directed in a direction other than a vertical direction when the communicating opening is directed in the vertical direction.

5. The revolver developing apparatus according to claim 4, wherein the communicating opening of each developing device is located at a lowest position of the developer storing section when each respective developing devices is located at the developing position.

6. The revolver developing apparatus according to claim 4, wherein:

the developer storing unit includes an opening that connects the developer storing section of the developing unit and a partition member; and the developer in the developer storing unit accumulates between the partition member and a side wall of the developer storing unit and moves toward the opening when the plurality of developing devices rotate.

7. The revolver developing apparatus according to claim 6, wherein a portion of the side wall of the developer storing unit is slanted in order to guide the developer in the developer storing unit to the developer storing section through the opening when the plurality of developing devices rotate.

8. A revolver developing apparatus, comprising:

a plurality of developing devices configured to rotate collectively such that each developing device moves selectively to a developing position in order to develop a latent image on an image bearing member, each developing device comprising, a developing unit configured to apply developer to the image bearing member, a developer storing unit configured to supply the developer to the developing unit, a separating member configured to separate a case of the developing unit into a developer storing section configured to store temporarily the developer supplied from the developer storing unit and into a developing section configured to apply the developer to the image bearing member, and a communicating opening situated between the developer storing section and the developing section provided at one side portion of the case such that the developer is conveyed from the developer storing section to the developing section through the communicating opening;

wherein the developer storing section and the communicating opening extend in a direction parallel to a widthwise direction of the image bearing member.

9. A revolver developing apparatus, comprising:

a plurality of developing devices configured to rotate collectively such that each developing device moves selectively to a developing position in order to develop a latent image on an image bearing member, each developing device comprising, a developing unit configured to apply developer to the image bearing member, a developer storing unit configured to supply the developer to the developing unit, a separating member configured to separate a case of the developing unit into a developer storing section configured to store temporarily the developer supplied from the developer storing unit and into a developing section configured to apply the developer to the image bearing member, and a communicating opening situated between the developer storing section and the developing section provided at one side portion of the case such that the developer is conveyed from the developer storing section to the developing section through the communicating opening;

wherein each developing device is configured such that the developer in the developer storing section falls to the developing section due to gravity when each respective developing device is located at the developing position.

10. A method for developing a latent image formed on an image bearing member with a developer into a toner image, comprising the steps of:

rotating collectively a plurality of developing devices such that each developing device moves selectively to a developing position in order to develop a latent image on an image bearing member, wherein each developing device includes a developing unit and a developer storing unit detachably connected to one another;

supplying developer to the developing unit such that the developer in the developer storing unit is conveyed longitudinally into the developing unit; and selectively applying developer to the image bearing member.

11. A revolver developing apparatus for developing a latent image formed on an image bearing member into a toner image, comprising:

a developing device configured to rotate, comprising, a developing unit configured to apply a developer to the image bearing member in order to develop the latent image, and a developer storing unit provided at an end of the developing unit, and configured to supply the developer to the developing unit, wherein said developing device rotates such that the developer in the developer storing unit is conveyed longitudinally into the developing unit, and the developing unit and the developing storing unit are detachably connected to one another.

12. A revolver developing apparatus, comprising:

a plurality of developing devices configured to rotate collectively such that each developing device moves selectively to a developing position in order to develop a latent image on an image bearing member, each developing device comprising, a developing unit configured to apply developer to the image bearing member, a developer storing unit configured to supply longitudinally the developer to the developing unit, a separating member configured to separate a case of the developing unit into a developer storing section configured to store temporarily the developer supplied from the developer storing unit and into a developing section configured to apply the developer to the image bearing member, and a communicating opening situated between the developer storing section and the developing section provided at one side portion of the case such that the developer is conveyed from the developer storing section to the developing section through the communicating opening;

wherein the developing unit and the developer storing unit are detachably connected to one another.

* * * * *

UNITED STATES PATENT AND TRADEMARK OFFICE

CERTIFICATE OF CORRECTION

PATENT NO. : 6,192,211
DATED : February 20, 2001
INVENTOR(S) : Kimura

It is certified that error appears in the above-identified patent and that said Letters Patent is hereby corrected as shown below:

On th title page, item (30) the foreign Application Priority Data is incorrect, item (30) should read as follows:

--(30) Foreign Application Priority Data

Jan. 29, 1999 (JP) ..... 11-021482
Dec. 28, 1999 (JP) ..... 11-373496 --

Signed and Sealed this

Fifth Day of June, 2001

Nicholas P. Godici

*Attest:*

NICHOLAS P. GODICI

*Attesting Officer*

*Acting Director of the United States Patent and Trademark Office*